US005372447A

United States Patent [19]

Chung

[11] Patent Number: 5,372,447

[45] Date of Patent: Dec. 13, 1994

[54] DOUBLE-BAR CONNECTING DEVICE

[76] Inventor: Ming-Dar Chung, 8, Lane 20, Long Ming Street, Chung Li City, Taoyuan Hsien, Taiwan, Prov. of China

[21] Appl. No.: 117,804

[22] Filed: Sep. 8, 1993

[51] Int. Cl.[5] ..... E04C 5/00

[52] U.S. Cl. ..... 403/171; 403/177; 403/176; 403/217; 403/169

[58] Field of Search ..... 446/126, 123, 119, 122; 52/655.2, 655.1, 646, 653.1, 81.3; 135/106, 101, 102, 105; 403/169–171, 176–178, 217, 396, 389

[56] References Cited

U.S. PATENT DOCUMENTS 2,018,539 10/1935 Welsh .
3,921,360 11/1975 Baldwin ..... 52/655.2
4,326,354 4/1982 Hagberg ..... 446/126
5,094,562 3/1992 Anderson ..... 403/170

*Primary Examiner*—Eric K. Nicholson
*Assistant Examiner*—Anthony Knight
*Attorney, Agent, or Firm*—Morton J. Rosenberg; David I. Klein

[57] ABSTRACT

This invention provides a double-bar connecting device which in one embodiment includes a cubic connector housing having three pairs of mutually orthogonal opposing surfaces. Each surface has two holes passing through to allow elongated bars having the same cross-section as the holes to snugly and tightly extend through the connector housing. Bolts may be provided to further secure the elongated bars to the connector housing. By positioning a number of such connector devices together with the elongated bars extending between connector housings, a three-dimensional frame structure is provided.

13 Claims, 3 Drawing Sheets

DOUBLE-BAR CONNECTING DEVICE

BACKGROUND OF THE INVENTION

1. Field of the Invention

The invention relates generally to a connecting device used in the construction of buildings or other large structures. In particular this invention relates to a connecting device that mechanically connects structural bars extending along three mutually orthogonal axes.

2. Prior Art

In the construction of buildings, structural bar members must be connected to form a structurally secure combination. For example, the connection of reinforcing bars necessary for structural integrity is seen at almost every construction site. In some prior art systems, the connection of reinforcing bars is accomplished by a welding technique. Such welding requires special equipment and trained personnel to complete the connection. A poor welding technique may result in failure to provide the required strength for structural integrity of a structure.

Additionally, in the preparation of a model of a building, connections associated with horizontal bar members cause tolerance problems and thus assembly precision in connecting the horizontal bar members may be difficult.

It is therefore desirable to provide a three-dimensional connecting device which provides a standardized connecting process for connecting bar members extending along three mutually orthogonal axes and also provides sufficient structural integrity for the structure being built.

SUMMARY OF THE INVENTION

It is a major objective of the present invention to provide a double-bar connecting device providing a cubic connector having three pairs of opposite surfaces with holes formed therethrough to securely receive structural bars therein, constituting a unit for a large frame structure.

It is also an objective of the present invention to provide a double-bar connecting device comprising a cubic connector having formed therethrough holes in the contour of circles, squares or other desired shapes to receive therein bars having cross-sectional contours of the same shape.

To achieve these objectives, there is provided a double-bar connecting device comprising a cubic connector having three pairs of opposite surfaces defining three substantially mutually orthogonal axes. Each surface has two holes formed therethrough to allow bars having the same cross-sectional contour to snugly interface and thus tightly extend therethrough. Bolts may be provided to further secure the bars to the connector. By arranging a number of such connectors together one by one along the three axes with bars extending therebetween a three-dimensional frame structure is provided.

BRIEF DESCRIPTION OF THE DRAWINGS

Other objectives and advantages of the invention will be apparent from the following description of preferred embodiments of the present invention taken in connection with the accompanying drawings wherein.

DETAILED DESCRIPTION OF THE PREFERRED EMBODIMENT

Figure 1:
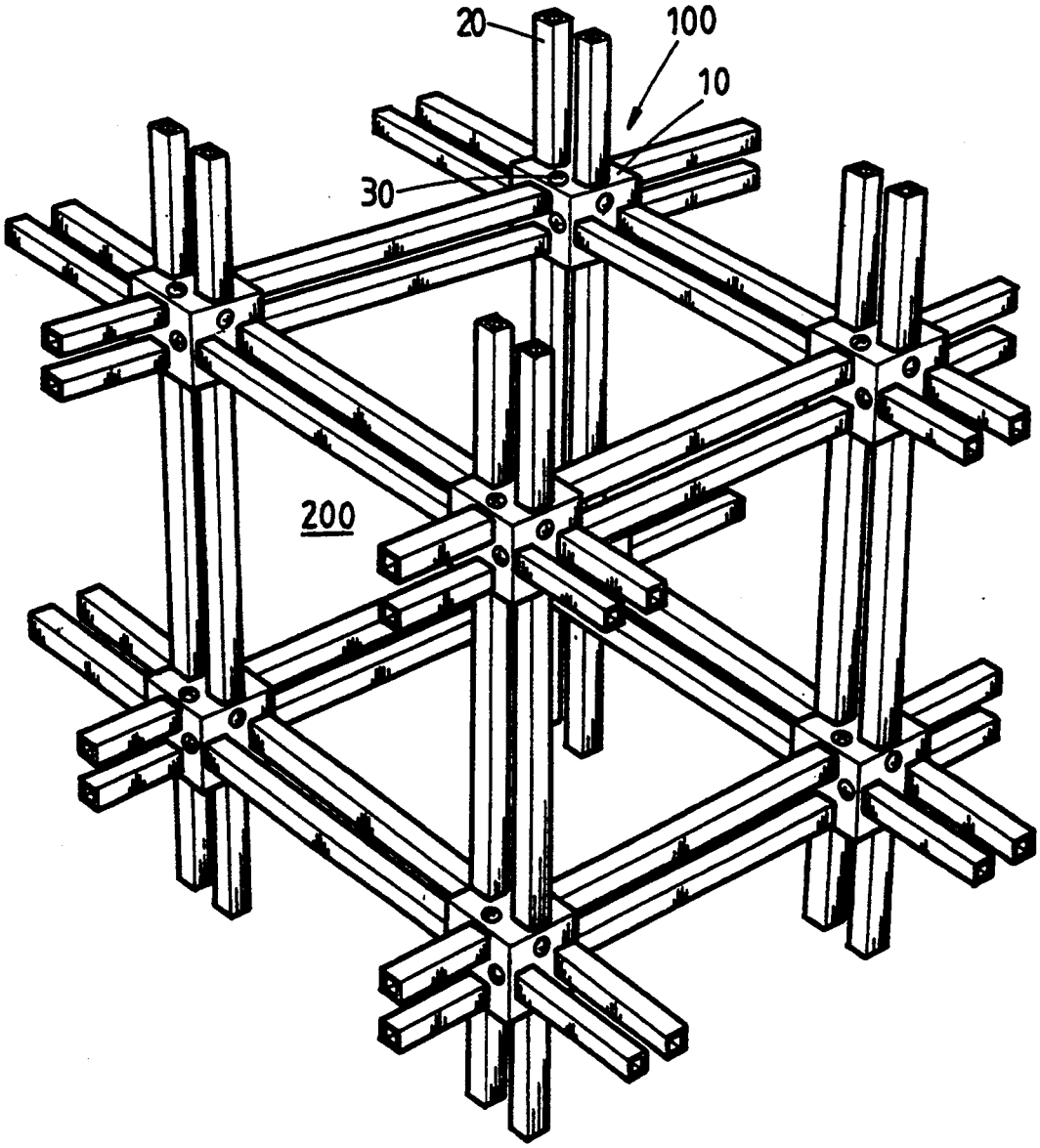
FIG. 1 is a perspective view showing a frame constructed with double-bars connected together by a double-bar connecting device in accordance with the present invention.

Referring to FIG. 1, there is shown a frame 200 constructed with double-bars 20 interconnected by double-bar connecting devices 100. The double-bar connecting devices 100 serve as node constructions or points with the double-bars 20 extending therebetween substantially along three mutually orthogonal linear axes or directions, such as the three coordinate axes of the Cartesian coordinate system, generally known as X-axis, Y-axis and Z-axis, to define a number of cubes stacked over each other as well as side-to-side to form the frame 200.

Figure 2:
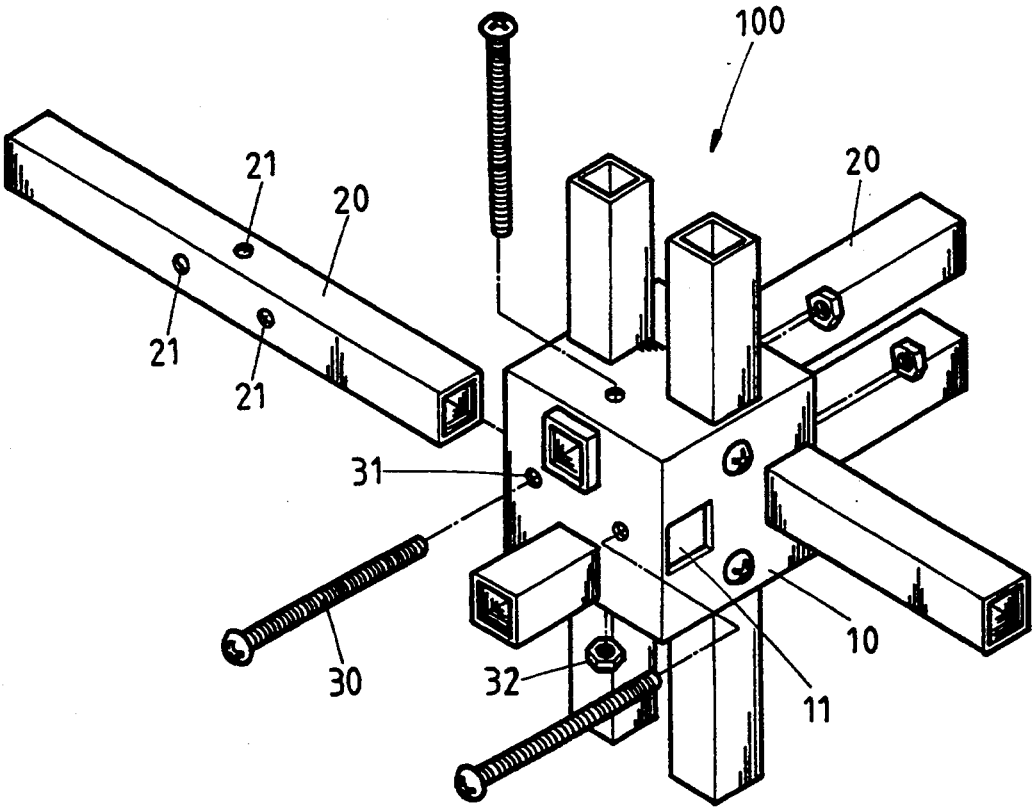
FIG. 2 is a perspective view partially exploded of the double-bar connecting device of the present invention.
Figure 3:
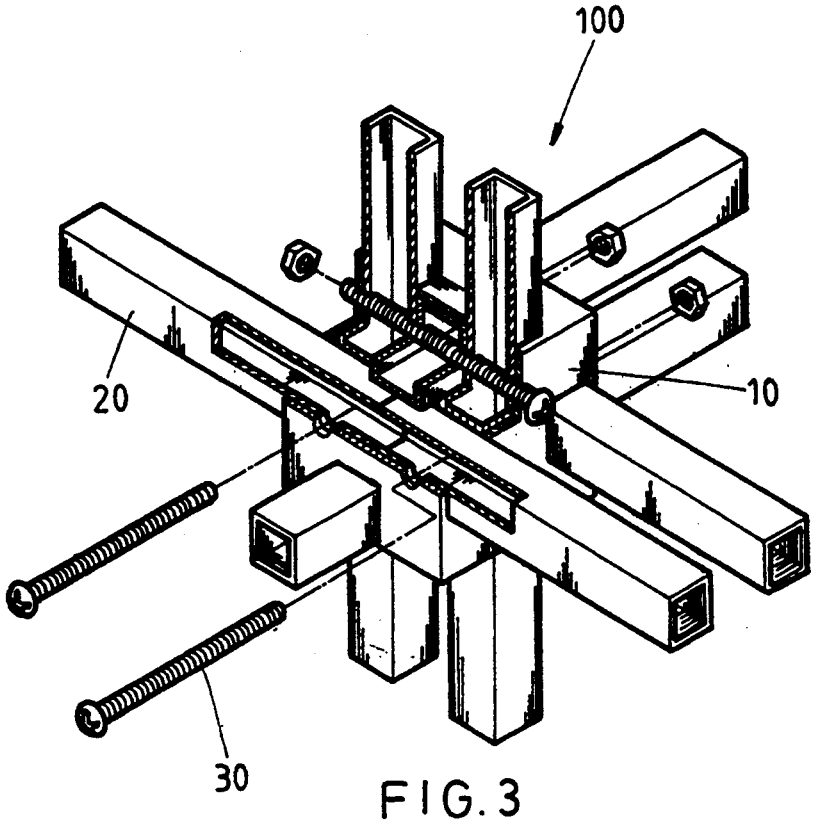
FIG. 3 is a perspective view, partially cut-away of the double-bar connecting device of the present invention.

Further referring to FIGS. 2 and 3, there is shown a unit of the double-bar connecting device 100 with double-bars 20 mounted thereto. Each unit of the double-bar connecting device 100 comprises a connector or connector housing 10, preferably in the contour of a cube having three pairs of opposite surfaces which are substantially mutually orthogonal so as to define the three orthogonal axes, each of the orthogonal axes being normal to each pair of the opposite surfaces.

On each surface of the cubic connector 10 there are provided two holes 11 formed to snugly and contiguously receive the bars 20 therethrough. The holes 11 through each of the opposing surfaces are exactly opposite or aligned so that the bars 20 extend completely through the connector housing 10 parallel to one axis of the coordinate system. Thus the bars 20 extend horizontally or vertically. The distance between the two holes 11 of each surface is preferably at least equal to the major dimension of the holes 11 and the dimension of the individual double-bars so that one set of double-bars 20 can be inserted between opposing double-bars 20.

Preferably, the size of the holes 11 is substantially the same as the cross-sectional size of the bars 20 so as to eliminate any substantial gap between the holes 11 and the bars 20 inserted therein.

Figure 5:
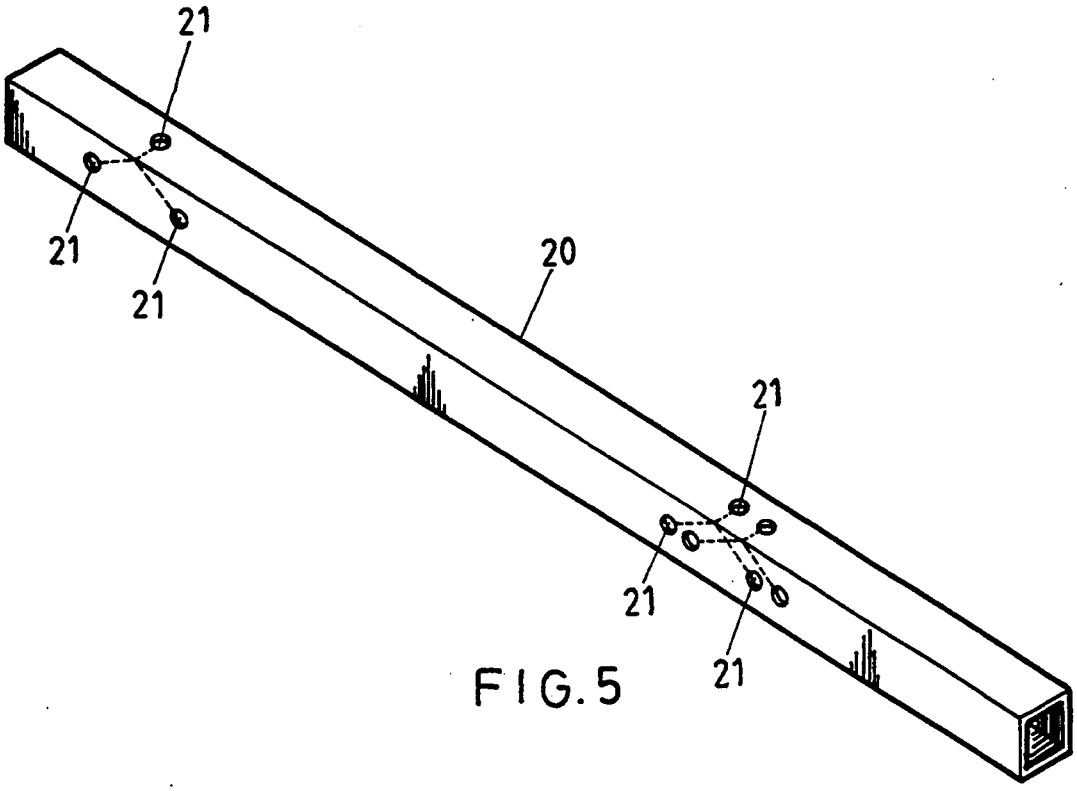

Also formed on each surface of the cubic connector housing 10 are apertures 31 to allow fasteners, such as bolts 30, to extend through for further securement of the bars 20 to the connector 10. Corresponding to the apertures 31, there are bolt holes 21 as shown in FIG. 5 formed through each of the bars 20 so that when the bar 20 is inserted into the holes 11 of the connector housings 10, the bolts 30 are insertable through both the apertures 31 and the bolt holes 21 of the bar 20 to secure the bar 20 to the connector housing 10. Nut members 32 may be provided to tighten the bolts 30 or alternatively inner threads may be provided in the bolt holes 21 or the apertures 31 for threaded engagement.

As shown in FIG. 5, for the connection between the connector 10 and each of the bars 20, preferably, each of the bars 20 has three bolt holes 21 formed therethrough, two of which bolt holes 21 corresponding to the two apertures 31 formed on one surface of the cubic connector 10 and the remaining bolt hole 21 corresponding to one of the two apertures 31 formed on an adjacent surface of the connector 10. This allows the bar 20 to be secured not only by the bolts 30 tightened on one surface of the connector housing 10 along one of the axes, but also one of the bolts 30 tightened on an adjacent surface along a perpendicular axis.

It is to be understood that for a heavy structural load condition, securement with fasteners or bolts 30 may be needed however, the bolts 30 may not be needed if the load is light and if the bars 20 have a cross-sectional size which allows them to be snugly and tightly received within the holes 11 of the connector 10.

Figure 4:
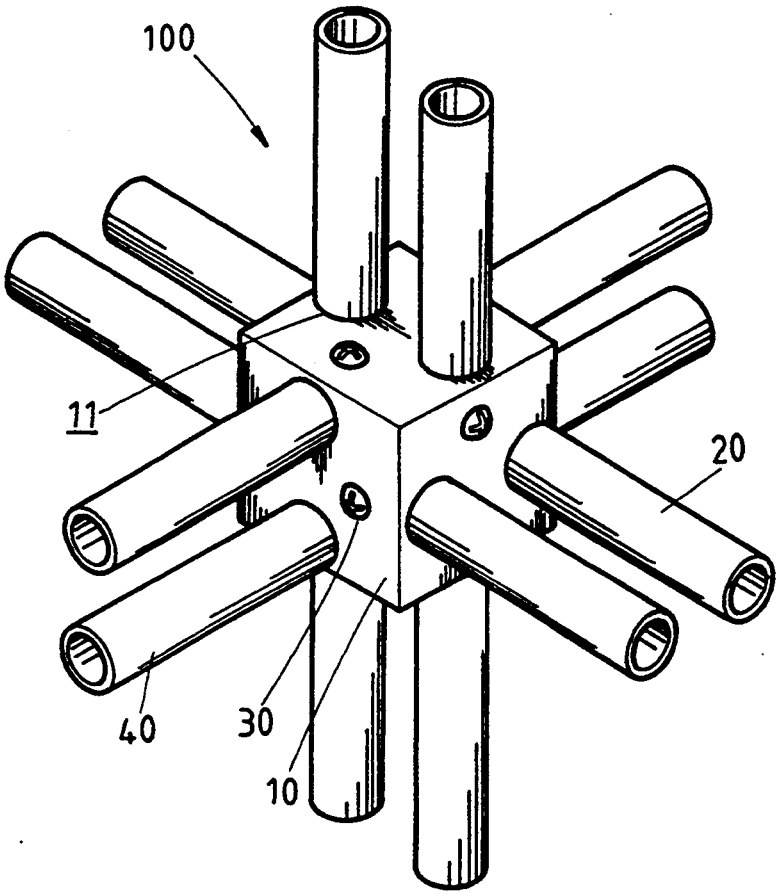
FIG. 4 is a perspective view showing a further embodiment of the double-bar connecting device constructed in accordance with the present invention; and, FIG. 5 is a perspective view showing an embodiment of the bar connectable by the double-bar connecting device of the present invention.

In the embodiment shown in FIGS. 1–3 and 5, the bars 20 extending between the connector housings 10 to form the frame 200 have a square or rectangular cross-section. Such a cross-section is convenient in assembly for forming the frame 200 but is more costly in manufacturing. To provide a more easily manufactured bar, a second embodiment of the bar is shown in FIG. 4 which has a circular cross-section which is easier to manufacture. Such circular bars 40 are mounted to the connector housing 10 in the same way as the square or rectangular bars 20 with the holes 11 of the connector 10 being circular, corresponding to the cross-section of the circular bars 40.

It is apparent that although the invention has been described in connection with the preferred embodiments, those skilled in the art may make changes to certain features of the preferred embodiments without departing from the spirit and scope of the invention as defined in the appended claims.

What is claimed is:

1. A double-bar connecting device comprising:

(a) a connector housing having three pairs of oppositely displaced and parallel surfaces, each of said pairs of surfaces being mutually orthogonal to the other of said pairs of surfaces, each of said pairs of surfaces having a pair of holes formed therethrough, said pair of holes formed through said displaced and parallel surfaces of each of said pairs of surfaces being coincidently aligned and of predetermined contour, said holes of each of said pairs of holes displaced from each other by a predetermined distance; and, (b) three pairs of elongated bars for insert into and through said connector housing through respective pairs of holes formed through said displaced and parallel surfaces, said elongated bars having the same contour as said predetermined hole contours and of a cross-sectional dimension size less than or equal to said predetermined distance between said holes of each of said pair of holes, each of said pairs of elongated bars being sandwiched between another pair of said elongated bars within said connector housing.

2. A double-bar connecting device as claimed in claim 1 further comprising fastener means for securing the elongated bars on said connector housing.

3. A double-bar connecting device as claimed in claim 2 wherein said fastener means comprises bolts extending through apertures formed through each of the surfaces of said connector housing and corresponding bolt holes formed through the elongated bars.

4. A double-bar connecting device as claimed in claim 3 wherein said fastener means further comprises nuts threadingly securing the bolts on said connector housing.

5. A double-bar connecting device as claimed in claim 1 wherein said connector housing comprises a cubic body having three pairs of mutually orthogonal surfaces defining three mutually orthogonal axes, along each of which a pair of the bars extend through said connector housing.

6. A double-bar connecting device as claimed in claim 5 further comprising fastener means to secure the elongated bars to said connector housing.

7. A double-bar connecting device as claimed in claim 6 wherein said fastener means comprises bolts extending through apertures formed through said connector housing and corresponding bolt holes formed through the elongated bars.

8. A double-bar connecting device as claimed in claim 7, wherein said fastener means further comprises nuts threadingly securing the bolts on said connector housing.

9. A double-bar connecting device as claimed in claim 5, wherein each of said mutually orthogonal surfaces comprises two apertures formed thereon, wherein each of the elongated bars comprises at least a set of three bolt holes formed thereon, two of which bolt holes corresponding to the two apertures of one of the surfaces to allow bolts extending through the apertures and the two bolt holes, the remaining bolt hole corresponding to one of the two apertures formed on an adjacent surface of said connector to allow a bolt extending therethrough.

10. A double-bar connecting device as claimed in claim 5 wherein the distance between the two holes formed on each of the surfaces of said connector housing for receiving therein the elongated bars is at least substantially equal to a major dimension of the holes.

11. A double-bar connecting device as claimed in claim 5 wherein the shape of the holes formed on each of the surfaces of said connector housing for receiving therein the elongated bars comprises a circular contour and the elongated bars has a circular cross section.

12. A double-bar connecting device as claimed in claim 5 wherein the shape of the holes formed on each of the surfaces of said connector housing for receiving therein the elongated bars comprises a square contour and each of the elongated bars has a square cross section.

13. A double-bar connecting device as claimed in claim 5 wherein the shape of the holes formed on each of the surfaces of said connector housing for receiving therein the elongated bars comprises a rectangular contour and each of the elongated bars have a rectangular cross section.

* * * * *